United States Patent [19]

Steiner et al.

[11] 4,273,990

[45] Jun. 16, 1981

[54] BASEBOARD HEATER WITH HIGH TEMPERATURE CUT-OFF SWITCH

[75] Inventors: Robert E. Steiner, Columbus, Ind.; Thomas J. Long, Florence, S.C.

[73] Assignee: Emerson Electric Co., St. Louis, Mo.

[21] Appl. No.: 103,605

[22] Filed: Dec. 14, 1979

[51] Int. Cl.[3] ..... H05B 1/02

[52] U.S. Cl. ..... 219/363; 219/364

[58] Field of Search ..... 219/363–365, 219/370, 371, 380–382

[56] References Cited

U.S. PATENT DOCUMENTS

| | | | |
|---|---|---|---|
| 2,971,075 | 2/1961 | Armstrong | 219/363 |
| 3,284,600 | 11/1966 | Mertler | 219/363 |
| 3,310,652 | 3/1967 | Williams, Jr. | 219/364 |
| 3,517,163 | 6/1970 | Leiner | 219/364 |
| 3,679,868 | 7/1972 | England | 219/364 |
| 3,731,247 | 5/1973 | Levinn | 219/363 |
| 3,810,065 | 5/1974 | Welsh | 219/513 |

*Primary Examiner*—Arthur T. Grimley
*Assistant Examiner*—Bernard Roskoski
*Attorney, Agent, or Firm*—Charles E. Markham

[57] ABSTRACT

A baseboard heater for mounting against a wall and spaced from the floor comprises a casing having an open bottom and upper front side which permits the free upward and then forward free flow of air therethrough. An elongated electrical heating element mounted therein adjacent the open bottom thereof is provided with a high temperature cut-off switch. A switch actuator including a sensing tube coextending alongside the heating element is cooled by incoming air to preclude switch actuation but is quickly heated by the heating element to effect cut-off when airflow is blocked.

2 Claims, 11 Drawing Figures

62
88
72
33
6
6
74
30
80
60

16
64
62
65
66
33
88
42

88
63
62

18
16
48
52
62
14
70
33
9
40
68
8
88
8
9
38
46
42

74
78

10
18
16
50
48
52
45
56
14
40
24
54
28
43
26
38
12
42
44

74
7
76
78
7

BASEBOARD HEATER WITH HIGH TEMPERATURE CUT-OFF SWITCH

This invention relates to baseboard heaters having electrical resistance heating elements and particularly to high temperature cut-off switch means which responds rapidly to excessive temperature at any point therealong.

BACKGROUND OF THE INVENTION

The importance of providing the best possible protection against overheating at any point along an electrical resistance type baseboard heater due to inadvertent blocking of convection air flow by drapes, furniture or other objects is well known and understood. Protective devices for this purpose have conventionally consisted of an expansible chamber actuated cut-off switch with an elongated sensing bulb or capillary tube containing a thermally expansible fluid connected to the expansible chamber and extending substantially the length of the heater.

Uniformity, reliability and quick response to overheating are of course of primary importance and a quicker response time of the cut-off switch permits the safe operation of the heating element at higher output. The positioning of the sensing capillary tube relative to the heating element and in the convection air stream is critical if reliable operation and quick response is to be achieved.

We have found by extending a sensing capillary tube containing a relatively low boiling point fluid along and in fixed predetermined spaced relationship with a conventional elongated electrical resistance heating element equipped with longitudinally spaced, radially extending fins, as by attaching the capillary to peripheral portions of at least some of the fins, that sufficient cooling by a free flowing convection air stream to preclude cut-off and a rapid cut-off in response to blockage of air flow may be achieved.

THE PRIOR ART

Heretofore it has usually been the practice to attach the cut-off switch and sensing capillary tube to the baseboard heater casing with the sensing capillary tube extending substantially the length of the casing in a position to be cooled by a free flowing convection air stream and relatively remote from the heating element to be heated radiantly thereby either directly or indirectly. An example of such arrangement is indicated in FIG. 1 of the accompanying copy of a White-Rodgers Application Guide for a Type 2B63 Electric Heat Limit. A suitable location of the sensing capillary tube in this arrangement is determined by cut-and-try method.

The U.S. Pat. No. 3,810,065 issued May 7, 1974, to James A. Welsh discloses an expansible chamber actuated high temperature cut-off switch with an attached sensing capillary tube filled with a relatively high boiling point liquid for protection against overheating in such devices as baseboard heaters, refrigeration and fire detection. The sensing capillary 62 in Welsh is not positioned so as to be normally cooled by air flow convected or otherwise. Referring to FIG. 5 of Welsh, the capillary 62 is embedded in a trough or groove 60 in a member 56 and is insulated from this member by a mylar insulator 63. The capillary is also positioned very closely adjacent the heating element 70. It appears therefore that the normal temperature of sensing capillary is quite high and is not modified or cooled by air flow but merely senses an increase in the temperature of the closely adjacent heating element 70 and fins 64 and 66.

OBJECTS OF THE INVENTION

The primary object of the invention is to provide a generally new and improved baseboard heater of the elongated electrical resistance type constructed so as to permit the free upward flow of convection air therethrough and including a reliable high temperature cut-off switch means quickly responsive to the occurrence of excessive temperature at any point therealong.

A further object is to provide a baseboard heater in which the temperature sensing element of a high temperature cut-off switch extends along an elongated electrical resistance heating element and is fixed thereto in such spaced relationship therewith as to be cooled sufficiently by the free flow of convection air to preclude operation of the switch but is heated rapidly to effect operation of the cut-off switch when air flow is blocked at any point therealong.

It is a further object to provide an elongated electrical resistance type heating element for a baseboard heater having longitudinally spaced and radially extending fins thereon and including a high temperature cut-off switch fixed thereto having an elongated temperature sensing element extending along the heating element and supported on the fins in a predetermined spaced relationship with the heating element.

Other objects and advantages will appear when reading the following description in connection with the accompanying drawings.

DESCRIPTION OF A PREFERRED CONSTRUCTION

Figure 1:
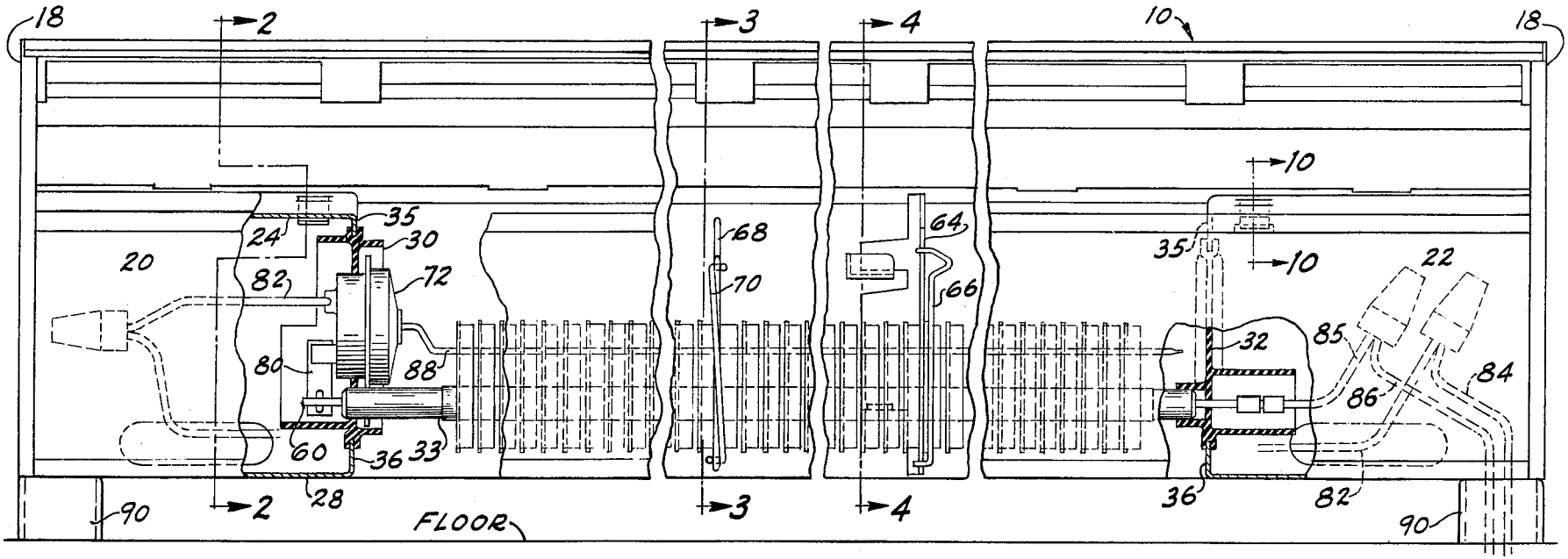
FIG. 1 is a front elevational view of a baseboard heater constructed in accordance with the invention with parts broken away to show interior construction.
Figure 9:
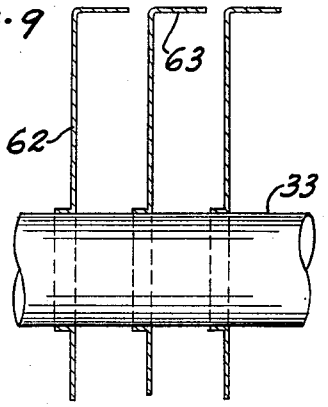
FIG. 9 is an enlarged fragmentary cross-sectional view showing attachment of the fins to the heating element and is taken along lines 9—9 of FIG. 3.
Figure 10:
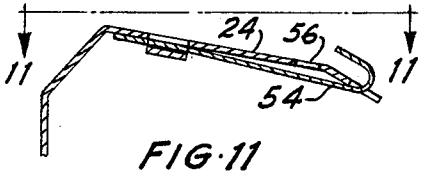
FIG. 10 is an enlarged fragmentary view taken along lines 10—10 of FIG. 1 showing the front cover retaining spring clip alone in an unstressed condition.
Figure 11:
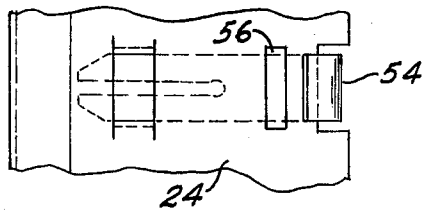
FIG. 11 is a fragmentary top view of the spring clip shown in FIG. 10 and is taken along lines 11—11 of FIG. 10.

Referring to FIGS. 1 to 4 of the drawings, the baseboard heater has an elongated sheet metal casing generally indicated at 10 having a rear side adapted to be suitable attached to a wall of a room in a horizontal position above the floor and with a forward or front side facing the room. The casing 10 comprises an elongated horizontal wall mounting panel 12, an elongated horizontal deflector panel 14, an elongated horizontal snap-on front cover panel 16 and vertical end closure panels 18 at both ends. The casing further includes left and right end terminal boxes formed therein generally indicated at 20 and 22 respectively.

The terminal boxes in transverse cross section each have on an inclined top wall 24, a rear vertical wall 26 and a horizontal bottom wall 28 which walls may be formed from a single metal sheet with their rear vertical walls 26 suitably attached to the adjacent vertical wall portion of wall mounting panel 12. The vertical outer end walls of terminal boxes 20 and 22 are formed by end closure panels 18 and the front walls by cover panel 16. The vertical inner end walls of the terminal boxes are formed by detachable insulator members 30 and 32 constructed of a dielectric material. The insulator members 30 and 32, which support opposite ends of an elongated horizontal electrical resistance heater element 33, are provided with grooves extending along the upper and lower edges thereof which slidably receive short vertically formed inner end portions 35 and 36 of the top and bottom walls 24 and 28 of the terminal boxes and are thereby retained in position.

In cross section the wall mounting panel 12 has an upper vertical portion 38 adapted to lie against the wall of a room, a portion 40 extending forward horizontally from the upper edge of portion 38 and forming the top wall of the casing, a lower vertical portion 42 spaced inwardly from the portion 38 so as to be spaced from the room wall, and a rectangular wire way 44 formed at the lower edge of portion 42 having a rear vertical wall adapted to lie against the room wall. Longitudinally spaced apertures 46 in the wall mounting panel are provided to receive suitable attaching screws for attaching the casing to a room wall.

In cross section the deflector panel 14 extends generally diagonally upward and forward from the lower edge of vertical portion 38 to the forward edge of horizontal portion 40 of the wall mounting panel 12 and is suitably attached at its edges to these portions. Elongated interrupted slots 43 and 45 near opposite edges of deflector 14 permit the flow of convection air between the deflector 14 and portions 38 and 40 of the wall mounting panel.

The snap-on front cover panel 16 which is spaced forwardly from wall mounting panel 12 and coextends vertically with the portion 42 has an inwardly formed lower edge portion 48 which locks in engagement with lips 50 formed along the forward edges of the lower walls 28 of each of the end terminal boxes. An inwardly formed upper edge portion 52 of cover panel 16 locks in engagement with the looped end of a leaf spring 54 mounted in each of the top walls 24 of the terminal boxes. The front cover panel 16 is of such width that the looped ends of leaf springs 54 are flexed downwardly when the upper formed edge 52 of cover panel 16 is engaged therewith and the panel then pressed downward sufficiently for engagement of its lower formed edge 48 with lips 50. Apertures 56 in the top walls 24 adjacent the looped ends of springs 54 provide access for depressing the springs 54 out of engagement with the formed upper edge 52 of cover panel 16 to permit removal of front panel 16.

The elongated horizontal electrical resistance element 33 is positioned in the lower portion of the casing 10 midway between the portion 42 of wall mounting panel 12 and front cover member 16. Heating element 33 comprises a round tubular casing having a conductor 60 extending therethrough and suitably insulated therefrom and extending from both ends of the casing. Heating element 33 is provided with vertically arranged longitudinally spaced rectangular fins 62 suitably attached thereto with upper and lower horizontal edges and vertical sides spaced from the heating element. Edge portions of the vertical sides of fins 62 are formed at 90 degrees to provide flanges 63 which extend longitudinally the greater part of the space between the fins thereby forming spaced vertical passageways which accelerate convection air flow and direct it vertically.

Figure 4:
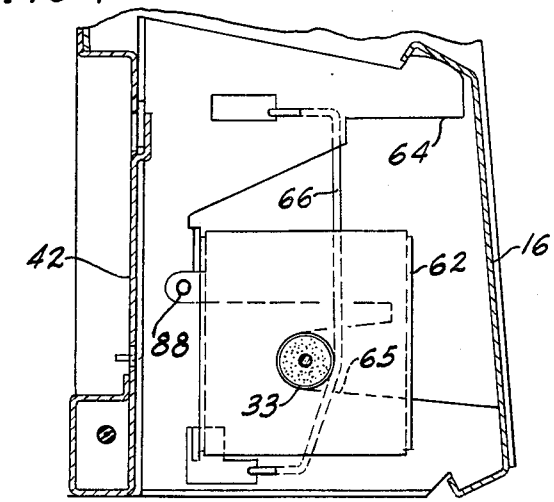
FIG. 4 is an enlarged cross-sectional view taken along lines 4—4 of FIG. 1.

Heating element 33 being supported at its ends in insulator members 30 and 32 in the lower central portion of the casing is also supported intermediately in a bracket 64 attached to the wall mounting panel 12, see FIG. 4. The heating element is entered horizontally into a recess 65 in bracket 64 and retained therein by a spring wire clip 66. The heating element 33 is also held in horizontal alignment at points along its length by spring wire clips 68 and 70 attached to the wall mounting panel 12. The bracket 64 also provides an intermediate support for snap-on cover panel 16.

Figure 5:
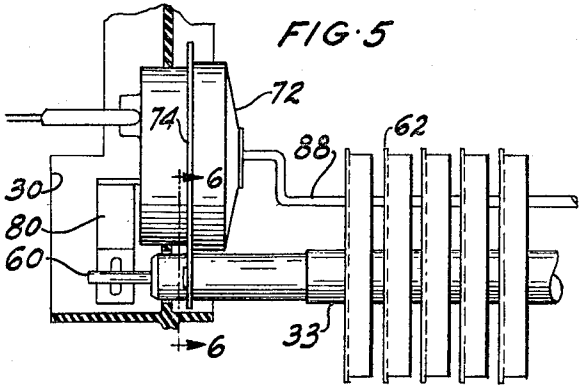
FIG. 5 is an enlarged fragmentary side elevational view of the left end portion of the heating element showing the attachment thereto of the expansible chamber actuated high temperature cut-off switch.

A normally closed expansible chamber actuated high temperature cut-off switch is enclosed in a casing 72 supported in the left hand insulator member 30. The casing 72 has a surrounding flange 74 having an aperture 76 therein through which a left end portion of the heating element 33 extends, see FIGS. 1 and 5. A pair of partially detached and deformable portions 78 of flange 74 extend into the aperture 76 normally obstruct passage of the heating element 33 therethrough but these portions are deformed and serve to hold the heating element securely in flange 74 when the heating element is forcibly pushed into the aperture. The right end portion of heating element 33 is fixed in insulator member 32. The left projecting end of conductor 60 is suitably attached, as by soldering, to a terminal 80 connected to one side of the cut-off switch. A lead 82 connected to the other side of the cut-off switch extends through the wire way 44 to the right hand terminal box 22 wherein it is connected to a power supply lead 84. The projecting right hand end of conductor 60 is connected by a lead 85 to another power supply lead 86. Hollow feet 90 positioned at each end of the casing 10 provide a passageway through which to extend unseen the power supply leads 84 and 86 from the casing to the floor.

Figure 8:
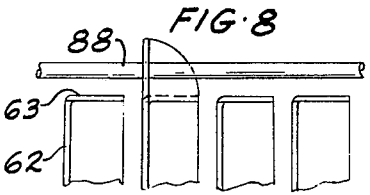
FIG. 8 is an enlarged fragmentary top view of the fins showing the position and attachment of the sensing capillary tube thereto and is taken along lines 8—8 of FIG. 3.
Figure 3:
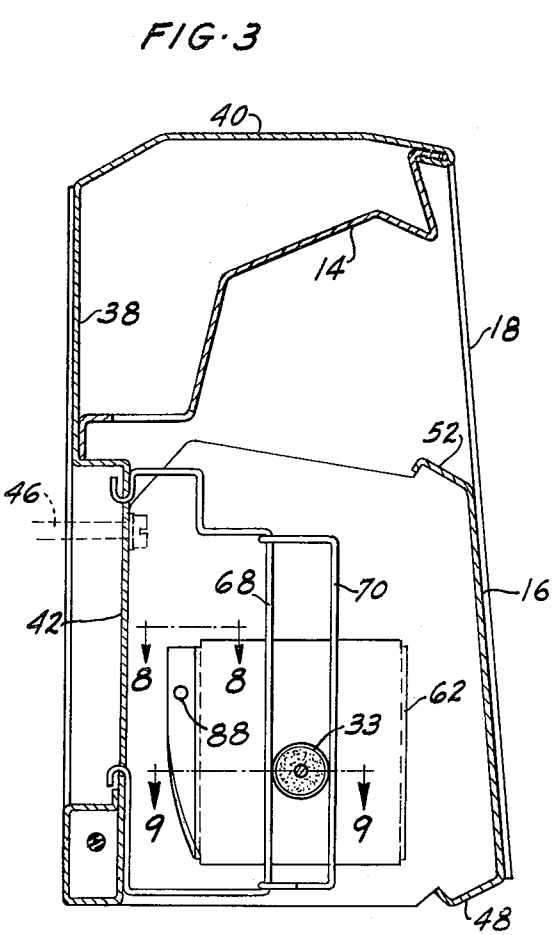
FIG. 3 is an enlarged cross-sectional view taken along lines 3—3 of FIG. 1.
Figure 7:
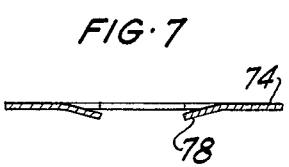
FIG. 7 is a cross-sectional view taken along line 7—7 of FIG. 6.
Figure 2:
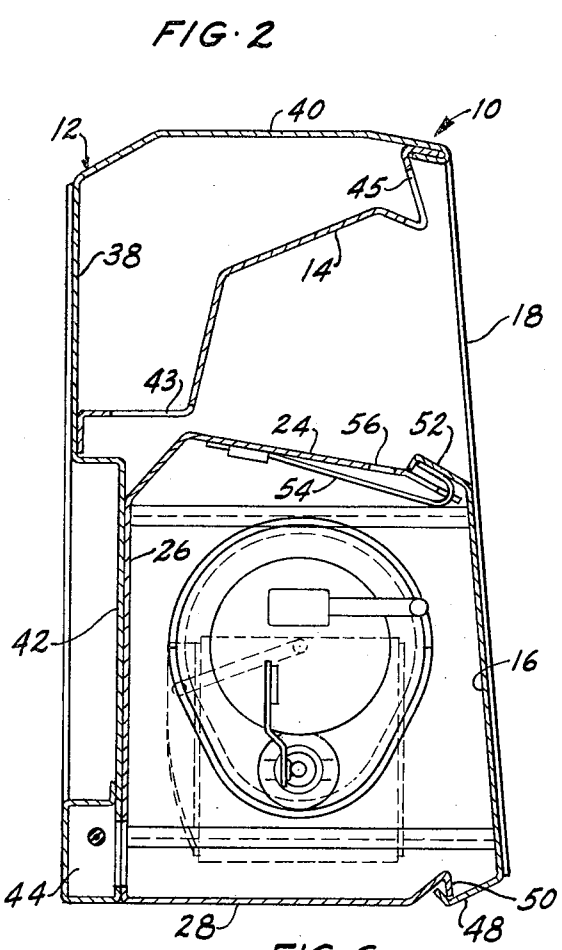
FIG. 2 is an enlarged cross-sectional view through the left end terminal box and is taken along lines 2—2 of FIG. 1.
Figure 6:
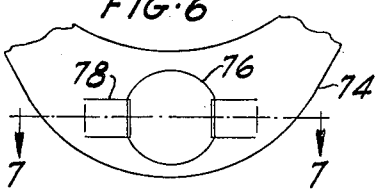
FIG. 6 is a further enlarged fragmentary front elevational view showing the flange aperture for receiving and retaining the left end of the heating element.

A sensing capillary tube 88 containing a thermally expansible fluid having a relatively low boiling point is connected at one end to the casing 72 in communication with an expansible chamber therein. The capillary tube 88 extends from casing 72 along the heating element between the heating element and the wall mounting panel 12 and closely adjacent the rear vertical sides of fins 62 to a closed end at substantially the right end of the heating element. The capillary tube 88 is supported and fixed in a predetermined spaced relationship with heating element 33 at spaced points therealong by passing it through apertures in outwardly formed portions of the fin flanges 63 as shown in FIGS. 3 and 8.

The casing 10 being spaced from the floor and being open at the bottom between the end terminal boxes and open at its upper forward side between the upper edge of cover member 16 and the forward edge of top wall 40 permits the free upward and forward flow of convection air therethrough. By positioning the sensing capillary tube in the lower portion of the casing and extending it along one side of the heating element so as to be in the vertical air stream it is sufficiently cooled by an unobstructed flow of relatively cool air entering the bottom of casing 10 to permit the use of a relatively low boiling point fluid therein which results in a rapid response of the cut-off switch to blockage of air flow either at the bottom or upper forward open portion of the casing.

The heating element with its fins, the expansible chamber actuated cut-off switch with its sensing capillary tube and the insulators form an integral subassembly adapted to convenient assembly or replacement in the casing 10.

We claim:

1. A baseboard heater comprising an elongated casing mounted horizontally against a wall of a room and spaced from the floor, the bottom and upper front side of said casing being open so as to permit the free vertically upward and then forward flow of air therethrough, said casing including a rear sidewall lying against the room wall and a partial front sidewall enclosing the lower front side of said casing, an elongated electrical resistance heating element positioned in the lower portion of said casing adjacent the open bottom thereof and extending longitudinally between said casing sidewalls, a high temperature cut-off switch controlling the flow of energy to said heating element, actuating means for said switch including a capillary tube containing a thermally expansible fluid which when heated sufficiently effects actuation of said switch, said heating element is equipped with a plurality of longitudinally, radially extending fins fixed thereon, and in which said capillary tube extends between a sidewall of said casing and the adjacent peripheries of said fins, and is connected to said adjacent peripheries of at least some of said fins so as to lie in and be cooled by the upward flow of substantially unheated air entering said open casing bottom.

2. The baseboard heater claimed in claim 1 in which the heat transfer relationship between said heater and said capillary tube causes said tube to be quickly heated sufficiently to effect cut-off when airflow through said casing is substantially blocked and in which said capillary tube is sufficiently cooled by a free flow of incoming unheated air to preclude its being heated sufficiently to effect cut-off.

* * * * *